US011342672B2

(12) United States Patent
Maruyama et al.

(10) Patent No.: US 11,342,672 B2
(45) Date of Patent: May 24, 2022

(54) ANTENNA DEVICE AND WIRELESS LAN COMMUNICATION DEVICE

(71) Applicant: BUFFALO INC., Nagoya (JP)

(72) Inventors: Jun Maruyama, Nagoya (JP); Hirotaka Naruse, Nagoya (JP); Yoshimitsu Kondo, Nagoya (JP)

(73) Assignee: BUFFALO INC., Nagoya (JP)

( * ) Notice: Subject to any disclaimer, the term of this patent is extended or adjusted under 35 U.S.C. 154(b) by 92 days.

(21) Appl. No.: 16/912,727

(22) Filed: Jun. 26, 2020

(65) Prior Publication Data

US 2021/0021036 A1 Jan. 21, 2021

(30) Foreign Application Priority Data

Jul. 18, 2019 (JP) ..... JP2019-132585

(51) Int. Cl.
*H01Q 5/48* (2015.01)
*H01Q 1/38* (2006.01)
*H01Q 21/29* (2006.01)

(52) U.S. Cl.
CPC ..... *H01Q 5/48* (2015.01); *H01Q 1/38* (2013.01); *H01Q 21/29* (2013.01)

(58) Field of Classification Search
CPC ..... H01Q 5/48; H01Q 1/38; H01Q 21/29; H01Q 21/10; H01Q 21/12; H01Q 1/521
USPC ..... 343/702
See application file for complete search history.

(56) References Cited

U.S. PATENT DOCUMENTS 5,905,468 A * 5/1999 Ikawa ..... H01Q 1/1278 343/713
6,388,621 B1 * 5/2002 Lynch ..... H01Q 1/125 343/700 MS
6,624,536 B1 9/2003 Sawada et al.
2008/0272976 A1 * 11/2008 Kitamori ..... H01Q 9/285 343/793
2009/0121964 A1 5/2009 Yamada et al.
2009/0137214 A1 * 5/2009 Hofmann ..... H04W 36/0083 455/82
2011/0274146 A1 * 11/2011 Huang ..... H01Q 1/38 375/219
2020/0091608 A1 * 3/2020 Alpman ..... H01Q 1/38

FOREIGN PATENT DOCUMENTS

EP 2091104 A1 8/2009
JP 2000-49487 A 2/2000
JP 2006-173910 A 6/2006
JP 2009-118406 A 5/2009
JP 2009-194864 A 8/2009
JP 2011-505727 A 2/2011

* cited by examiner

*Primary Examiner* — Hai V Tran
(74) *Attorney, Agent, or Firm* — Xsensus LLP

(57) ABSTRACT

An antenna device that includes a first antenna configured to perform communication using a predetermined frequency band, and a second antenna configured to perform communication using the predetermined frequency band, and the first antenna and the second antenna are arranged such that amplitude directions of radio waves which are output from the first antenna and the second antenna coincide with each other.

14 Claims, 6 Drawing Sheets

ANTENNA DEVICE AND WIRELESS LAN COMMUNICATION DEVICE

CROSS-REFERENCE TO RELATED APPLICATION

This application is based on and claims priority under 35 USC 119 from Japanese Patent Application No. 2019-132585 filed on Jul. 18, 2019, the contents of which are incorporated herein by reference.

TECHNICAL FIELD

The present disclosure relates to an antenna device and a wireless LAN communication device.

BACKGROUND

A technology capable of performing wireless communication using an MISO (Multiple Input, Single Output) connection using a plurality of antennae is known (see Japanese Patent Application National Laid-Open No. 2011-505727 for instance). In the technology of the related art, in the case where wireless communication using an MISO connection is performed, it is possible to perform communication using a plurality of antennae in one wavelength band. Therefore, it is possible to perform communication using a plurality of antennae in a wider wavelength band than a wavelength band which is used in the case of individually using each of the plurality of antennae.

In the technology of the related art, variation in the signal intensities of transmission signals of the individual antennae in a certain direction may occur. In this case, the communication speed or communication range of the communication device may be limited depending on the antenna having the lowest signal intensity among the plurality of antennae.

This problem is not limited to wireless communication using MISO connections, and may occur in common in the case of performing communication using a plurality of antennae in one wavelength band.

SUMMARY

The present disclosure provides an antenna device comprising: a first antenna configured to perform communication using a predetermined frequency band; and a second antenna configured to perform communication using the predetermined frequency band, wherein the first antenna and the second antenna are arranged such that amplitude directions of radio waves which are output from the first antenna and the second antenna coincide with each other.

The present disclosure further provides a wireless LAN communication device comprising: an antenna device including a first antenna configured to perform communication using a predetermined frequency band; and a second antenna configured to perform communication using the predetermined frequency band, wherein the first antenna and the second antenna are arranged such that amplitude directions of radio waves which are output from the first antenna and the second antenna coincide with each other; a first RF (Radio Frequency) circuit electrically connected to the first antenna; a second RF (Radio Frequency) circuit electrically connected to the second antenna; and baseband processing circuitry configured to perform communication using the first antenna and the second antenna by radio waves in the predetermined frequency band, the baseband processing circuitry being connected to the first antenna through the first RF circuit, and connected to the second antenna through the second RF circuit.

DETAILED DESCRIPTION

A. First Embodiment

Figure 1:
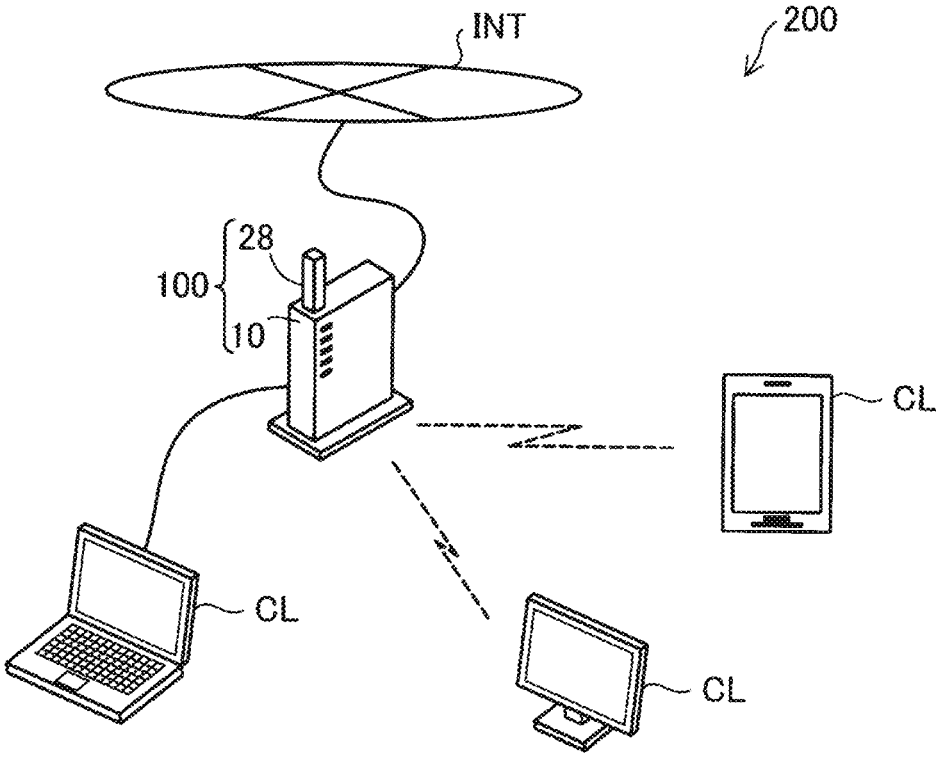
FIG. 1 is a schematic configuration diagram of a network system including a wireless LAN access point as a first embodiment.

FIG. 1 is a schematic configuration diagram of a network system 200 including a wireless LAN (Local Area Network) access point 100 as a first embodiment. The network system 200 includes the wireless LAN access point 100 and client devices CL.

The wireless LAN access point 100 includes a main body part 10 for performing communication control, data processing, and so on in the wireless LAN access point 100, and an antenna device 28 having antennae usable for wireless communication. The wireless LAN access point 100 is connected to the Internet INT through a cable. The wireless LAN access point 100 connects the client devices CL, such as personal computers, smart phones, and tablet computers, by radio communication using the antenna device 28. Also, the wireless LAN access point 100 can perform wired communication with client devices CL connected thereto through cables. Therefore, the wireless LAN access point 100 also function as a wired LAN access point. However, the wireless LAN access point 100 may not have the function of serving as a wired LAN access point.

Figure 2:
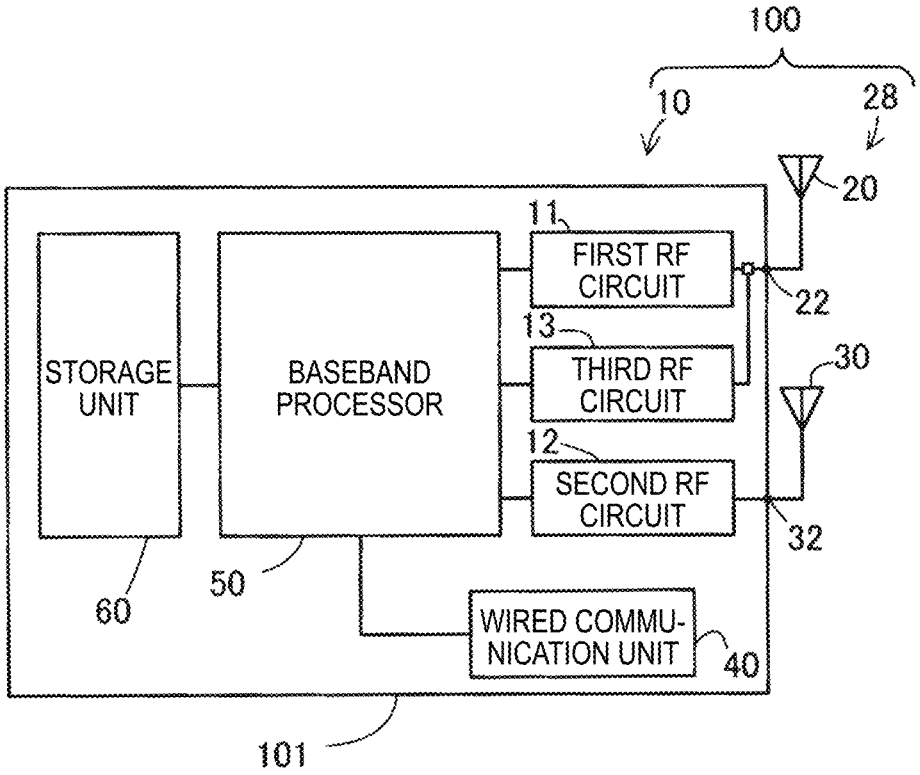
FIG. 2 is a block diagram illustrating the internal configuration of the wireless LAN access point.

FIG. 2 is a block diagram illustrating the internal configuration of the wireless LAN access point 100. In the present embodiment, the wireless LAN access point 100 is capable of wireless communication using a band of 5 GHz (GigaHertz) as a frequency band. The band of 5 GHz is further divided into three frequency bands, i.e. a band of 5.2 GHz, a band of 5.3 GHz, and a band of 5.6 GHz. The band of 5.2 GHz is a frequency band from 5170 MHz (MegaHertz) to 5250 MHz. The band of 5.3 GHz is a frequency band from 5330 MHz to 5350 MHz. The band of 5.6 GHz is a frequency band from 5490 MHz to 5730 MHz. Also, the wireless LAN access point 100 is capable of wireless communication using a band of 2.4 GHz as a frequency band. In the present embodiment, the band of 2.4 GHz and the band of 5 GHz are frequency bands defined by the IEEE (Institute of Electrical and Electronics Engineers) 802.11 standard. More specifically, the band of 5.2 GHz, the band of 5.3 GHz, and the band of 5.6 GHz are frequency bands defined by W52, W53, and W56 described in the ordinance of the Japan's Ministry of Internal Affairs and Communications, respectively.

The main body part 10 includes a housing 101, and a first RF (Radio Frequency) circuit 11, a second RF circuit 12, a third RF circuit 13, a wired communication unit 40, a baseband processor 50, and a storage unit 60 having memories such as a RAM (Random Access Memory) and a ROM (Read Only Memory), stored in the housing 101.

The antenna device 28 includes a first antenna 20, a second antenna 30, a terminal part 22 for electrically connecting the first antenna 20 to the first RF circuit 11 and the third RF circuit 13, and a terminal part 32 for electrically connecting the second antenna 30 and the second RF circuit 12.

The first antenna 20 is a multi-antenna usable for wireless communication in two wavelength bands, i.e. the band of 5 GHz and the band of 2.4 GHz. As the first antenna 20, various antennae such as dipole antennae, monopole antennae, Uda-Yagi antennae can be used. In the present embodiment, the first antenna 20 is a dipole antenna. The first antenna 20 performs communication in the band of 5 GHz in response to electric signals which are output from the first RF circuit 11, and performs communication in the band of 2.4 GHz in response to electric signals which are output from the third RF circuit 13. By the way, in the present embodiment, the first antenna 20 has four antenna elements, i.e. first antenna elements 204 to be described below, such that 4-by-4 MIMO (Multiple Input, Multiple Output) communication becomes possible. However, the number of antenna elements which are provided in the first antenna 20 may be five or more, or may be three or less.

The second antenna 30 is an antenna usable for wireless communication using the band of 5 GHz as a wavelength band, similarly to the first antenna 20. As the second antenna 30, various antennae such as dipole antennae, monopole antennae, Uda-Yagi antennae can be used. In the present embodiment, the second antenna 30 is an antenna of the same type as the first antenna 20, specifically, a dipole antenna. The second antenna 30 performs communication in the band of 5 GHz in response to electric signals which are output from the second RF circuit 12. By the way, in the present embodiment, the second antenna 30 has four antenna elements, i.e. second antenna elements 304 to be described below, such that 4-by-4 MIMO communication becomes possible. However, the number of antenna elements which are provided in the second antenna 30 may be five or more, or may be three or less.

As described above, the first antenna 20 and the second antenna 30 are capable of communication using one frequency band predetermined for them, specifically, the band of 5 GHz. The one predetermined frequency band means frequency bands which can be handled as the same frequency band in wireless communication and in which it is possible to make the amplitude directions of radio waves coincide with each other.

The baseband processor 50 includes a CPU and so on. The baseband processor 50 performs wireless communication using the first antenna 20 and the second antenna 30 electrically connected, by executing a program stored in the storage unit 60. In the present embodiment, the baseband processor 50 performs wireless communication based on, for example, IEEE 802.11a, n, ac, and ax.

The baseband processor 50 can perform wireless communication using the first antenna 20 and the second antenna 30 in a wavelength bandwidth of 160 MHz, as wireless communication based on IEEE 802.11ax. In this case, each of the first antenna 20 and the second antenna 30 is capable of wireless communication in a wavelength band width of 80 MHz.

In the present embodiment, when each of the first antenna 20 and the second antenna 30 performs wireless communication in the band of 5 GHz, it performs wireless communication using channels belonging to one of W52, W53, and W56. Specifically, the first antenna 20 performs wireless communication using, for example, four channels which consist of CH. 100, CH. 104, CH. 108, and CH. 112 of channels belonging to W56 and have a total bandwidth of 80 MHz. Also, the second antenna 30 performs wireless communication using, for example, four channels which consist of CH. 116, CH. 120, CH. 124, and CH. 128 of channels belonging to W56 and have a total bandwidth of 80 MHz.

The baseband processor 50 can combine eight channels to be used for communication of the first antenna 20 and the second antenna 30 into one by channel bonding. Therefore, the wireless LAN access point 100 is capable of communication using the bandwidth of 160 MHz. Also, the baseband processor 50 performs wireless communication using an MIMO system. In the present embodiment, the baseband processor 50 is capable of wireless communication using 8×8 MIMO using the eight antenna elements 204 and 304 included in the first antenna 20 and the second antenna 30.

Figure 3:
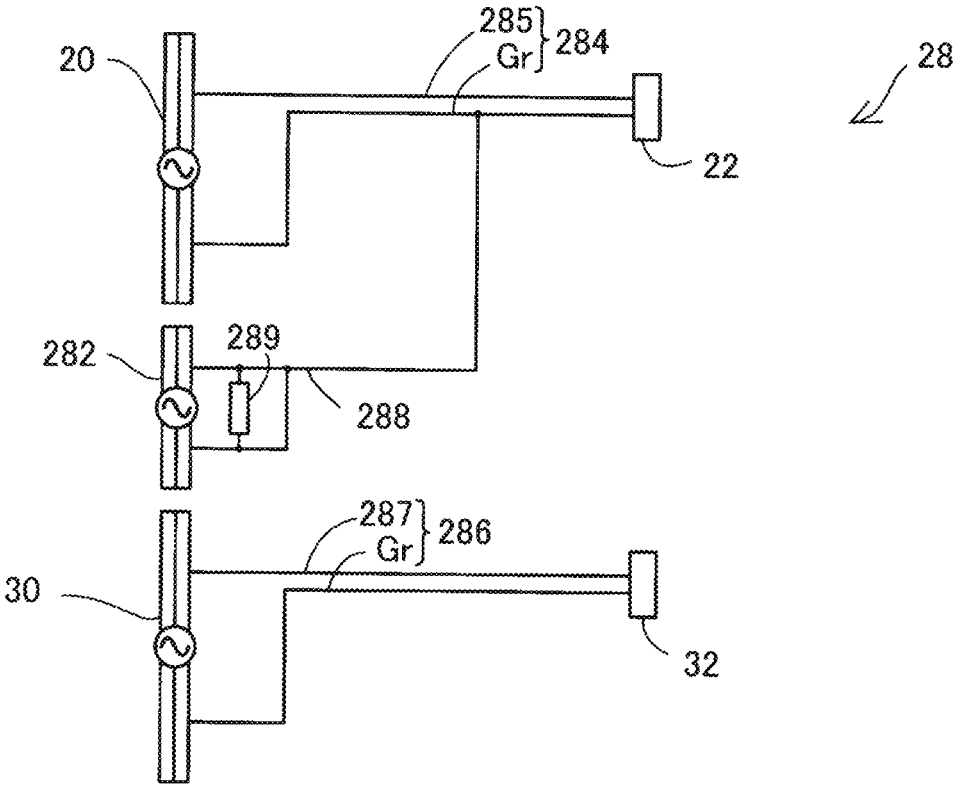
FIG. 3 is a schematic diagram of an antenna device.

FIG. 3 is a schematic diagram of the antenna device 28. The antenna device 28 includes an element 282, a first wiring line 284, a second wiring line 286, and a third wiring line 288, in addition to the first antenna 20 and the second antenna 30 described above.

The first wiring line 284 is a coaxial cable having a core conductor 285 and an outer conductor Gr serving as a ground. The first wiring line 284 electrically connects the first antenna 20 and the terminal part 22 usable for electrical connection with the outside. Also, the first wiring line 284 electrically connects the first antenna 20 and the ground.

Similarly to the first wiring line 284, the second wiring line 286 is a coaxial cable having a core conductor 287 serving as a power line and an outer conductor Gr serving as a ground. The second wiring line 286 electrically connects the second antenna 30 and the terminal part 32 usable for connection with the outside. Also, the second wiring line 286 electrically connects the second antenna 30 and the ground.

The third wiring line 288 is connected to the element 282 and the outer conductor Gr of the first wiring line 284. The third wiring line 288 has a terminating resistor 289. The resistance value of the terminating resistor 289 is determined according to output impedance which is output from the first RF circuit 11 of FIG. 2 to the first antenna 20. The resistance value of the terminating resistor 289 is set to about 50Ω.

The element 282 is a conductor capable of absorbing radio waves which are transmitted from each of the first antenna 20 and the second antenna 30. In the present embodiment, the element 282 has a metal element made by imitating a dipole antenna. A current generated by a radio wave received by the element 282 is consumed as heat by the terminating resistor 289. As a result, radio wave interference between the first antenna 20 and the second antenna 30 decreases. Therefore, it is possible to reduce the distance between the first antenna elements 204 and the second antenna elements 304.

Figure 4:
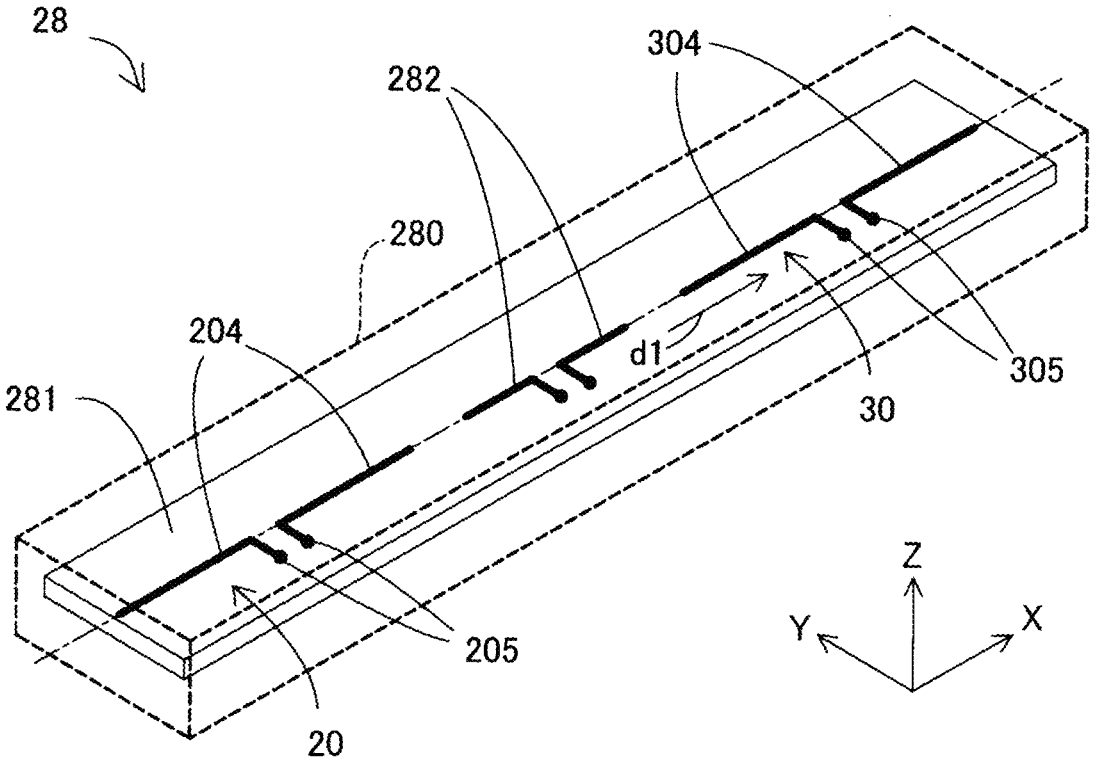
FIG. 4 is a schematic diagram for explaining the positional relation between first antenna elements and second antenna elements.

In the present embodiment, the distance between the first antenna 20 and the second antenna 30 in an X-axis direction of FIG. 4 is 30 mm shorter than 50 mm required in the case where there is no element 282. Therefore, it is possible to set the dimension of an antenna housing 280 in the X-axis direction to 170 mm. However, the element 282 may not be necessarily provided. In the case where the element 282 is not provided, the distance between the first antenna 20 and the second antenna 30 may be increased to increase the degree of isolation.

The first antenna 20 and the second antenna 30 are arranged so as to satisfy an arrangement condition. The arrangement condition is a condition that the amplitude directions of radio waves which are output from the first antenna 20 and the second antenna 30 coincide with each other. Coincidence between the amplitude directions of radio waves means that the polarization plane of the first antenna 20 and the polarization plane of the second antenna 30 coincide with each other.

FIG. 4 is a schematic diagram for explaining the positional relation between the first antenna elements 204 and the second antenna elements 304. In FIG. 4, the antenna housing 280 accommodating the first antenna 20 and the second antenna 30 is shown by broken lines. The first antenna 20 includes the antenna elements 204 usable to transmit and receive radio waves, and first antenna terminals 205 for inputting and outputting signals for transmission and reception of radio waves using the first antenna elements 204 to and from the first antenna elements 204. The second antenna 30 includes the second antenna elements 304 usable to transmit and receive radio waves, and second antenna terminals 305 for inputting and outputting signals for transmission and reception of radio waves using the second antenna elements 304 to and from the second antenna elements 304. The first antenna 20 and the second antenna 30 are arranged on a thin-plate-like antenna substrate 281. In each of the first antenna 20 and the second antenna 30, the four antenna elements are provided as described above; however, for convenience, only one antenna element is shown in the drawing.

In FIG. 4, an X axis, a Y axis, and a Z axis perpendicular to one another are shown. The X axis is a directional axis extending in parallel with a first direction dl in which the first antenna elements 204 extend, of directions along a main surface of the antenna substrate 281. The Y axis is a directional axis perpendicular to the first direction dl in which the first antenna elements 204 extend, of directions along the main surface of the antenna substrate. The z axis is a directional axis extending in a direction perpendicular to the main surface of the antenna substrate. The first direction dl is the longitudinal direction of the first antenna 20.

In the present embodiment, the first antenna elements 204 and the second antenna elements 304 are arranged so as to be aligned in the first direction dl. Therefore, the above-mentioned arrangement condition is satisfied. In other words, the first antenna elements 204 and the second antenna elements 304 are arranged so as to be aligned with each other in a straight line. "Being aligned in the first direction dl" means that the angle between the extension direction of the second antenna elements 304 and the first direction dl is equal to or smaller than 2°. Also, in this case, it is preferable that the angle between the extension direction of the second antenna elements 304 and the first direction dl is equal to or smaller than 1°. Further, it is more preferable that the angle between the extension direction of the second antenna elements 304 and the first direction dl is equal to or smaller than 0.5°, and it is most preferable that the angle is 0°.

Since the first antenna elements 204 and the second antenna elements 304 are arranged so as to be aligned in the first direction dl, it is possible to make the amplitude direction of radio waves which are transmitted from the first antenna 20 and the amplitude direction of radio waves which are transmitted from the second antenna 30 coincide with each other. Therefore, in a communication target which receives radio waves transmitted from the first antenna 20 and the second antenna 30, reception intensity during reception of radio waves transmitted from the first antenna 20 and reception intensity during reception of radio waves transmitted from the second antenna 30 become equal. Therefore, the wireless LAN access point 100 can reduce the possibility that the communication range or the communication speed will vary when the first antenna 20 and the second antenna 30 are compared. Also, since the first antenna elements 204 and the second antenna elements 304 are arranged so as to be aligned in the first direction dl, it is possible to reduce the dimension of the antenna device 28 in the first direction dl.

Making the amplitude directions of radio waves coincide with each other means making the angle between the amplitude direction of radio waves which are transmitted from the first antenna 20 and the amplitude direction of radio waves which are transmitted from the second antenna 30 between 0° and 3°. It is preferable that the angle between the amplitude direction of radio waves which are transmitted from the first antenna 20 and the amplitude direction of radio waves which are transmitted from the second antenna 30 is between 0° and 2°. Further, it is more preferable that the angle between the amplitude direction of radio waves which are transmitted from the first antenna 20 and the amplitude direction of radio waves which are transmitted from the second antenna 30 is between 0° and 1°, and it is most preferable that the angle is 0°.

Determination on whether the amplitude directions of radio waves coincide with each other can be performed by measuring the antenna gain of each of the first antenna 20 and the second antenna 30 in a three-dimensional direction and comparing the measurement results. Specifically, in the case where the maximum gain direction of the first antenna 20 and the maximum gain direction of the second antenna 30 coincide with each other, it is possible to determine that the amplitude directions of radio waves of the first antenna 20 and the second antenna 30 coincide with each other.

In the present embodiment, the first antenna 20, the second antenna 30, and the element 282 are arranged on one antenna substrate 281. The first antenna 20, the second antenna 30, and the element 282 are stored in the antenna housing 280 in the state where they have been arranged on the thin-plate-like antenna substrate 281. Therefore, the relative positional relation of the first antenna 20, the second antenna 30, and the element 282 does not change even though the posture of the antenna housing 280 changes. Therefore, the amplitude directions of the first antenna 20 and the second antenna 30 are maintained in the state where they coincide with each other.

Figure 5:
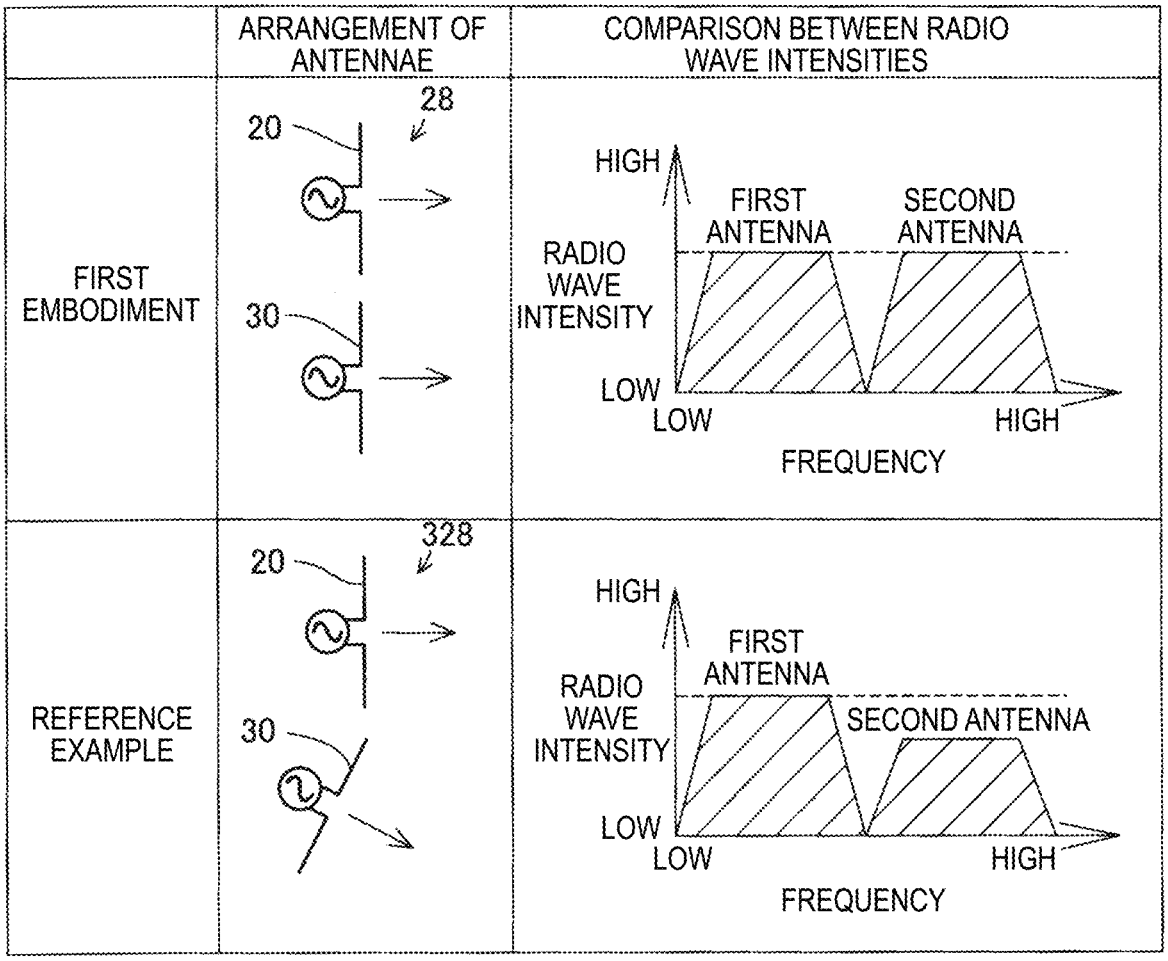
FIG. 5 is a table for comparing an antenna device of the first embodiment and an antenna device of a reference example.

FIG. 5 is a table for comparing the antenna device 28 of the first embodiment and an antenna device 328 of a reference example. On the upper side of the sheet of FIG. 5, on the left side, the arrangement of the first antenna 20 and the second antenna 30 in the antenna device 28 according to the first embodiment is schematically shown, and on the right side, the radio wave intensities of the first antenna 20 and the second antenna 30 are schematically shown. Also, on the lower side of the sheet, on the left side, the arrangement of a first antenna 20 and a second antenna 30 in the antenna device 328 according to the reference example is schematically shown, and on the right side, the radio wave intensities of the first antenna 20 and the second antenna 30 in the reference example are schematically shown. To compare radio wave intensities which are output from the first antennae 20 and radio wave intensities which are output from the second antennae 30, radio wave intensities in the maximum gain directions of the first antennae 20 are used.

As shown in the drawing, in the antenna device 328 according to the reference example, the amplitude directions of radio waves of the first antenna 20 and the second antenna 30 do not coincide with each other. Therefore, in the maximum gain direction of the first antenna 20, the radio wave intensity of the second antenna 30 becomes lower than the radio wave intensity of the first antenna 20. As a result, in the antenna device 328 of the reference example, the communication speed and the communication range are limited by the antenna having the lower radio wave intensity, of the two antennae. Therefore, in the antenna device 328 of the reference example, as compared to the antenna device 28 of the first embodiment, the communication speed and the communication range decrease.

According to the above-described first embodiment, the antenna device 28 includes the first antenna 20 and the second antenna 30 arranged so as to satisfy the arrangement condition that the amplitude directions of radio waves which are output from the first antenna 20 and the second antenna 30 coincide with each other. Therefore, in the wireless LAN access point 100, the amplitude directions of signals of the first antenna 20 and the second antenna 30 coincide with each other. Therefore, the possibility that variation in the communication ranges or communication speeds of the first antenna 20 and the second antenna 30 will occur decreases. Therefore, the possibility that one of the first antenna 20 and the second antenna 30 will greatly restrict communication of the other decreases.

Also, according to the above-described first embodiment, whether the arrangement condition of the first antenna 20 and the second antenna 30 is satisfied or not can be determined on the basis of whether the first antenna elements 204 and the second antenna elements 304 are aligned in the first direction dl. Therefore, it is possible to visually check whether the arrangement condition is satisfied. Therefore, as compared to the case of checking whether the arrangement condition is satisfied with a measuring device or the like, it is possible to reduce the manufacturing cost of the antenna device 28.

Also, according to the above-described first embodiment, the antenna device 28 includes the element 282. Therefore, radio waves which are transmitted from the first antenna 20 toward the second antenna 30 and radio waves which are transmitted from the second antenna 30 toward the first antenna 20 are absorbed by the element 282. Therefore, it is possible to improve the degree of isolation between the first antenna 20 and the second antenna 30. Therefore, as compared to the case where the element 282 is not provided, it is possible to reduce the distance between the first antenna 20 and the second antenna 30. Therefore, it is possible to reduce the dimensions of the antenna device 28.

Also, according to the above-described first embodiment, the antenna device 28 performs wireless communication in a bandwidth of 160 MHz, using the first antenna 20 and the second antenna 30 each of which is capable of wireless communication in a bandwidth of 80 MHz. Therefore, it is possible to commonly use antennae of other antenna devices for performing wireless communication in a bandwidth of 80 MHz. For this reason, it is not necessarily needed to separately prepare an antenna capable of wireless communication in a bandwidth of 160 MHz, for the antenna device 28. Therefore, as compared to the case of using one antenna capable of wireless communication in a bandwidth of 160 MHz, it is possible to reduce the manufacturing cost.

B. Second Embodiment

Figure 6:
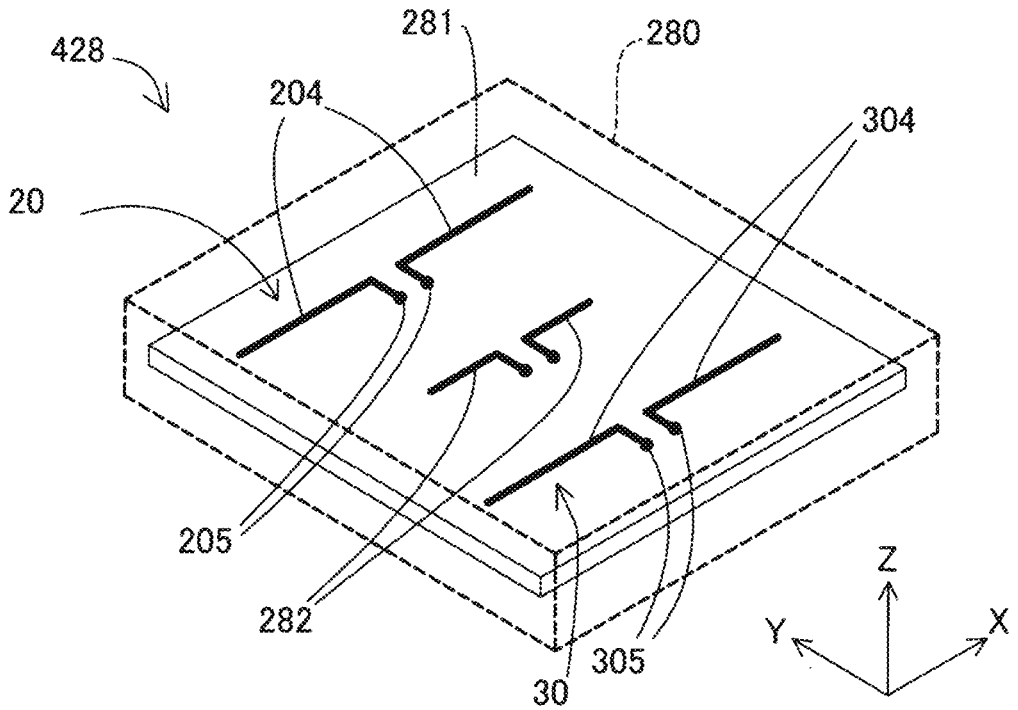
FIG. 6 is a schematic diagram illustrating the arrangement of antennae in an antenna device according to a second embodiment.

FIG. 6 is a schematic diagram illustrating an arrangement of antennae in an antenna device 428 according to a second embodiment. The antenna device 428 according to the second embodiment is different from the first embodiment in the arrangement of the first antenna elements 204 and the second antenna elements 304. Hereinafter, components identical to those of the first embodiment are denoted by the same reference symbols, and a detailed description thereof will not be made.

In the antenna device 428, the first antenna elements 204 and the second antenna elements 304 are arranged so as to be aligned in a Y-axis direction. The Y-axis direction is a direction perpendicular to the extension direction of the first antenna elements 204. Even in the case, similarly in the case of the first embodiment, the arrangement condition is satisfied.

According to the above-described second embodiment, similarly in the first embodiment, the possibility that variation in the communication ranges or communication speeds of the first antenna 20 and the second antenna 30 will occur decreases. Therefore, the possibility that one of the first antenna 20 and the second antenna 30 will restrict communication of the other decreases. Further, according to the antenna device 428 of the second embodiment, it is possible to restrain the size of the antenna device 428 in the X-axis direction from increasing.

Also, according to the second embodiment, since the element 282 is arranged between the first antenna 20 and the second antenna 30, it is possible to reduce the distance between the first antenna 20 and the second antenna 30 even if the maximum gain direction of the first antenna 20 is a direction from the first antenna 20 to the second antenna 30.

C. Third Embodiment

Figure 7:
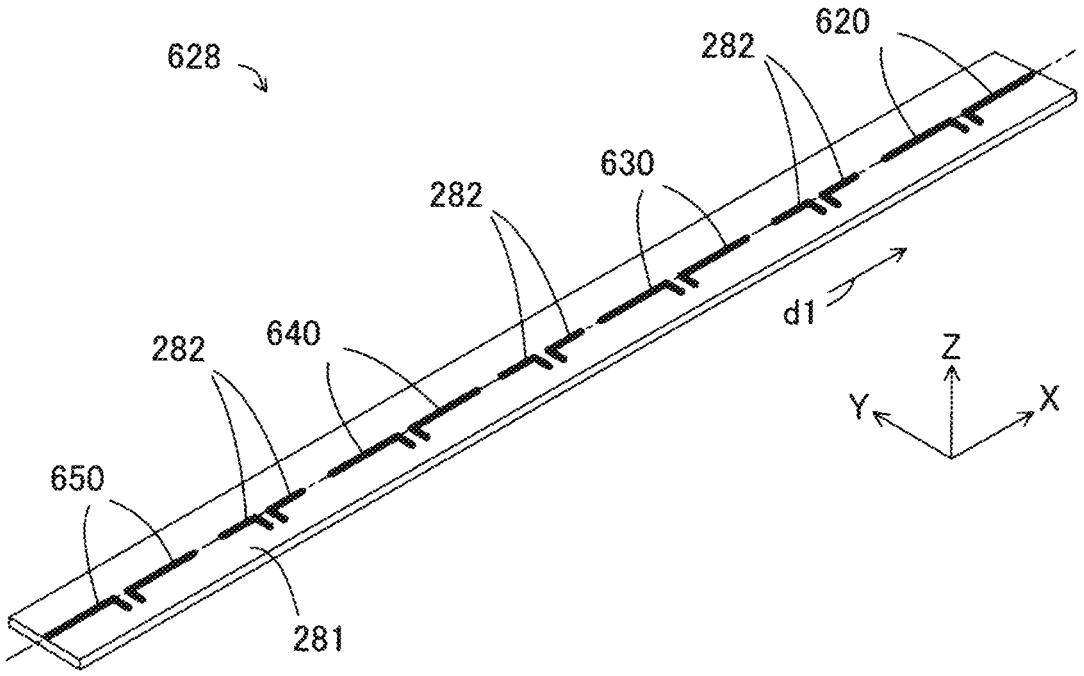
FIG. 7 is a schematic diagram illustrating the arrangement of antennae in an antenna device according to a third embodiment.

FIG. 7 is a schematic diagram illustrating an arrangement of antennae in an antenna device 628 according to a third embodiment. The antenna device 628 according to the third embodiment is different from the antenna device 28 of the first embodiment in that it further includes a third antenna 640 and a fourth antenna 650 in addition to a first antenna 620 and a second antenna 630. The first antenna 620, the second antenna 630, the third antenna 640, and the fourth antenna 650 are aligned in a straight line in the first direction dl on one antenna substrate 281. Also, of the four antennae 620, 630, 640, and 650 of the present embodiment, two antennae adjacent to each other correspond to a first antenna and a second antenna described in the first embodiment.

Also, the antenna device 628 according to the third embodiment includes three elements 282. The elements 282 are arranged between the first antenna 620 and a second antenna 630, between the second antenna 630 and the third antenna 640, and between the third antenna 640 and the fourth antenna 650. Therefore, the degree of isolation between the four antennae 620, 630, 640, and 650 improves.

In the case of performing wireless communication using the antenna device 628 according to the third embodiment, it is possible to combine channels with bandwidths of 80 MHz usable for communication of the four antennae 620, 630, 640, and 650 by channel bonding. Therefore, the wireless LAN access point is capable of wireless communication in the bandwidth of 320 MHz, using the antenna device 628.

D. Other Embodiments

D1. First Embodiment of Others

In the above-described embodiments, the antennae (for example, the first antenna 20 and the second antenna 30) are dipole antennae, but are not limited thereto. For example, instead of dipole antennae, various antennae may be used. Specifically, for example, in the first embodiment, the first antenna 20 and the second antenna 30 may be antennae (for example, monopole antennae) having antenna elements extending in a straight line similarly in dipole antennae. In this case, if the antenna elements of the two monopole antennae are arranged in a straight line in the first direction dl similarly in the first embodiment, the arrangement condition is satisfied.

Also, a type of antennae (for example, planar antennae such as patch antennae) which do not have antenna elements extending in a straight line may be used as the first antenna 20 and the second antenna 30. Even in this case, if the first antenna 20 and the second antenna 30 are arranged so as to satisfy the arrangement condition, the possibility that variation in the communication ranges or communication speeds of the first antenna 20 and the second antenna 30 will occur decreases.

D2. Second Embodiment of Others

In the above-described embodiments, the positional relation between the first antenna 20 and the second antenna 30 is maintained since they are arranged on one antenna substrate. However, disposition for maintaining the positional relation between the first antenna 20 and the second antenna 30 is not limited thereto. For example, the first antenna 20 and the second antenna 30 may be attached to different antenna substrates, respectively. In this case, in the antenna housing 280, the first antenna 20 and the second antenna 30 may be fixed at predetermined positions. Specifically, in the state where the substrate for the first antenna 20 and the substrate for the second antenna 30 have inserted into attachment recesses formed in the antenna housing 280, the first antenna 20 and the second antenna 30 may be fixed with fixing members. Even in this case, the amplitude directions of radio waves which are radiated from the first antenna 20 and the second antenna 30 are maintained in the state where they coincide with each other.

D3. Third Embodiment

In the above-described embodiments, the number of antennae which are provided in the antenna device 28, 428, or 628 is not limited to 2 or 4. For example, the number of antennae capable of communication in one frequency band determined for them in advance may be three, or five or more.

D4. Fourth Embodiment

In the above-described embodiments, the antennae (for example, the first antenna 20 and the second antenna 30) which are used in the antenna device 28, 428, or 628 are capable of wireless communication in bandwidths of 80 MHz, but are not limited thereto. For example, the antennae which are used in the antenna device 28, 428, or 628 may be capable of wireless communication in bandwidths wider than 80 MHz, or may be capable of wireless communication in bandwidths narrower than 80 MHz. Specifically, for example, each of the first antenna 20 and the second antenna 30 used in the antenna device 28 according to the first embodiment may be capable of wireless communication in bandwidths of 160 MHz. In this case, the antenna device 28 is capable of wireless communication in the bandwidth of 320 MHz. Also, for example, each of the first antenna 20 and the second antenna 30 used in the antenna device 28 according to the first embodiment may be capable of wireless communication in bandwidths of 40 MHz. In this case, the antenna device 28 is capable of wireless communication in the bandwidth of 80 MHz.

D5. Fifth Embodiment

In the above-described embodiments, the antenna device 28, 428, or 628 is used in the wireless LAN access point 100, but is not limited thereto. For example, the antenna device 28, 428, or 628 may be usable in wireless LAN communication devices other than wireless LAN access points such as wireless LAN relays which can be connected to the Internet INT through wireless LAN access points.

D6. Sixth Embodiment of Others

In the above-described embodiments, the first antenna 20 and the second antenna 30 are capable of communication in the band of 5 GHz for them, but are not limited thereto. For example, the first antenna 20 and the second antenna 30 may be capable of communication using a frequency band other than the band of 5 GHz as a predetermined frequency band for them. Wireless communication using a frequency band other than the band of 5 GHz is, for example, wireless communication using a sub-GHz band which is a frequency band of less than 1 GHz (between 916.5 MHz and 927.5 MHz).

D7. Seventh Embodiment of Others

In the above-described embodiments, the wireless LAN access point 100 performs channel bonding, but is not limited thereto. The wireless LAN access point 100 may not perform channel bonding. Also, the wireless LAN access point 100 performs wireless communication using MIMO, but is not limited thereto. For example, the wireless LAN access point 100 may perform wireless communication using SISO (Single-Input, Single-Output) or MISO, instead of wireless communication using MIMO.

Even in the first to seventh embodiments of others described above, since they have the same configuration as those of the first to third embodiments, the same effect is achieved.

The present disclosure can be implemented as the following modes.

(1) According to a mode of the present disclosure, an antenna device is provided. This antenna device includes a first antenna and a second antenna that are capable of communication using predetermined one frequency band predetermined, and that are arranged such that an arrangement condition is satisfied, wherein the arrangement condition is a condition that the amplitude directions of radio waves which are output from the first antenna and the second antenna coincide with each other. According to the antenna device of this mode, since the first antenna and the second antenna are used, it is possible to perform communication in a wavelength band wider than that in the case of individually using each of the first antenna and the second antenna. In this case, the antenna device satisfies the arrangement condition of the first antenna and the second antenna. Therefore, variation in the signal intensities of signals which are transmitted from the first antenna and the second antenna decreases.

(2) The antenna device of the above-mentioned mode may further include first antenna elements provided in the first antenna, and second antenna elements provided in the second antenna, wherein the first antenna and the second antenna may be antennae of the same type and are either dipole antennae or monopole antennae, and the first antenna elements and the second antenna elements may be aligned in a direction in which the first antenna elements extend to satisfy the arrangement condition. Whether the antenna device of this mode satisfies the arrangement condition can be visually checked. Therefore, it is unnecessary to use a special device or the like to arrange the first antenna and the second antenna. Therefore, the cost required for manufacturing the antenna device decreases. Also, since the first antenna elements and the second antenna elements are arranged so as to be aligned in the extension direction of the first antenna elements, the size of the antenna device in a direction perpendicular to the first antenna elements is restrained from increasing.

(3) The antenna device of the above-mentioned mode may further include first antenna elements provided in the first antenna, and second antenna elements provided in the second antenna, wherein the first antenna and the second antenna may be antennae of the same type and are either dipole antennae or monopole antennae, and the first antenna elements and the second antenna elements may be aligned in a direction perpendicular to a direction in which the first antenna elements extend to satisfy the arrangement condition. Whether the antenna device of this mode satisfies the arrangement condition can be visually checked. Therefore, it is unnecessary to use a special device or the like to arrange the first antenna and the second antenna. Therefore, the cost required for manufacturing the antenna device decreases. Also, since the first antenna elements and the second antenna elements are arranged so as to be aligned in the direction perpendicular to the first antenna elements, the size of the antenna device in the extension direction of the first antenna elements is restrained from increasing.

(4) The antenna device of the above-mentioned mode may further include an element that is arranged between the first antenna and the second antenna and is a conductor capable of absorbing radio waves which are transmitted from each of the first antenna and the second antenna, wherein the element may be connected to a terminating resistor and a ground. According to the antenna device of this mode, radio waves which are transmitted from the first antenna toward the second antenna and radio waves which are transmitted from the second antenna toward the first antenna are absorbed by the element. Therefore, it is possible to improve the degree of isolation between the first antenna and the second antenna.

(5) According to another mode of the present disclosure, a wireless LAN communication device is provided. This wireless LAN communication device includes the antenna device of the above-mentioned mode, two RF (Radio Frequency) circuits electrically connected to the first antenna and the second antenna, respectively, and a baseband processor connected to the first antenna and the second antenna through the two RF circuits, wherein the baseband processor performs communication using the first antenna and the second antenna by radio waves in the one frequency band. According to the wireless LAN communication device of this mode, since the arrangement condition of the first antenna and the second antenna is satisfied, variation in the signal intensities of signals which are transmitted from the first antenna and the second antenna decreases.

(6) In the wireless LAN communication device of the above-mentioned mode, the first antenna and the second antenna may be used for communication using different channels, respectively, and the baseband processor may combine the channels which are used for wireless communication of the two antennae by channel bonding. The wireless LAN communication device of this mode can improve communication speed.

(7) In the wireless LAN communication device of the above-mentioned mode, the first antenna and the second antenna may be capable of transmission and reception of radio waves in bandwidths of 80 MHz, respectively, and the wireless LAN communication device may be capable of communication in the bandwidth of 160 MHz by the channel bonding. According to this mode, the wireless LAN communication device capable of communication in the bandwidth of 160 MHz, using the first antenna and the second antenna capable of transmission and reception of radio waves in the bandwidths of 80 MHz is provided.

The present disclosure can be implemented in various modes other than the antenna device and the wireless LAN communication device. For example, the present disclosure can be implemented in modes such as methods of manufacturing antenna devices, wireless LAN communication devices other than wireless LAN communication devices such as wireless LAN relays, and network systems including wireless LAN communication devices.

The present disclosure is not limited to the above-described embodiments, and can be implemented in a variety of configurations without departing from the scope of the present disclosure. For example, the technical features of the embodiments corresponding to the technical features of the individual modes described in Summary of the disclosure may be replaced or combined appropriately, in order to solve some or all of the problems described above or in order to achieve some or all of the effects described above. In addition, if a technical feature is not described as one which is essential in the present specifications, it is able to be removed as appropriate.

The invention claimed is:

1. An antenna device having a X direction and a Y direction from a top view of the antenna device, the antenna device comprising:

a first antenna configured to perform communication using a predetermined frequency band, the first antenna including a plurality of first antenna elements extending on a first reference line in the X direction; and a second antenna configured to perform the communication using the predetermined frequency band, the second antenna including a plurality of second antenna elements extending on a second reference line in the X direction, wherein the first antenna and the second antenna are arranged such that amplitude directions of radio waves which are output from the first antenna and the second antenna coincide with each other, and the first reference line and the second reference line are a same reference line extending in the X direction.

2. The antenna device according to claim 1, wherein the first antenna and the second antenna are antennae of a same type and are either dipole antennae or monopole antennae.

3. The antenna device according to claim 1, wherein an angle between are amplitude direction of radio waves which are transmitted from the first antenna and an amplitude direction of radio waves which are transmitted from the second antenna is equal to or larger than 0°, and is equal to or smaller than 3°.

4. The antenna device according to claim 1, wherein a polarization plane of the first antenna and the polarization plane of the second antenna coincide with each other.

5. The antenna device according to claim 1, wherein a maximum gain direction of the first antenna and a maximum gain direction of the second antenna coincide with each other.

6. The antenna device according to claim 1, further comprising:

three conductors configured to absorb radio waves which are transmitted from each of the first antenna and the second antenna, wherein four of the first antenna elements are provided in the first antenna, four of the second antenna elements are provided in the second antenna, a first conductor of the three conductors is provided between a second and a third antenna elements of the four first antenna elements, a second conductor of the three conductors is provided between a second and a third antenna elements of the four second antenna elements, a third conductor of the three conductors is provided between a first antenna element of the four first antenna elements and a fourth antenna element of the four second antenna elements, and the four first antenna elements, the four second antenna elements, and the three conductors extend on the same reference line in the X direction.

7. An antenna device having a X direction and a Y direction from a top view of the antenna device, the antenna device comprising:

a first antenna configured to perform communication using a predetermined frequency band, the first antenna including a plurality of first antenna elements;

a second antenna configured to perform the communication using the predetermined frequency band, the second antenna including a plurality of second antenna elements; and a conductor configured to absorb radio waves which are transmitted from each of the first antenna and the second antenna, the conductor being provided between the first antenna and the second antenna, wherein the first antenna and the second antenna are arranged such that amplitude directions of radio waves which are output from the first antenna and the second antenna coincide with each other, each of the plurality of first antenna elements extends on a first reference line in the X direction, and each of the plurality of second antenna elements extends on a second reference line in the X direction, the second reference line being parallel to the first reference line and different from the first reference line.

8. The antenna device according to claim 7, wherein a line connecting a center of the first antenna and a center of the second antenna extends in the Y direction.

9. The antenna device according to claim 8, wherein a length of the first antenna in a longitudinal direction thereof and in the X direction and a length of the second antenna in a longitudinal direction thereof and in the X direction are the same.

10. The antenna device according to claim 7, wherein the conductor is connected to a terminating resistor and a ground.

11. The antenna device according to claim 7, wherein the first antenna, the second antenna, and the conductor are provided on an antenna substrate and are stored in an antenna housing.

12. A wireless LAN communication device comprising:

an antenna device having a X direction and a Y direction from a top view of the antenna device, the antenna device including a first antenna configured to perform communication using a predetermined frequency band, the first antenna including a plurality of first antenna elements extending on a first reference line in the X direction; and a second antenna configured to perform the communication using the predetermined frequency band, the second antenna including a plurality of second antenna elements extending on a second reference line in the X direction, wherein the first antenna and the second antenna are arranged such that amplitude directions of radio waves which are output from the first antenna and the second antenna coincide with each other, the first reference line and the second reference line are a same reference line extending in the X direction;

a first RE (Radio Frequency) circuit electrically connected to the first antenna;

a second RF (Radio Frequency) circuit electrically connected to the second antenna; and baseband processing circuitry configured to perform the communication using the first antenna and the second antenna by radio waves in the predetermined frequency band, the baseband processing circuitry being connected to the first antenna through the first RF circuit, and connected to the second antenna through the second RF circuit.

13. The wireless N communication device according to claim 12, wherein the first antenna and the second antenna are used for the communication using different channels, respectively, and the baseband processing circuitry is configured to combine the different channels which are used for wireless communication of the first antenna and the second antenna by channel bonding.

14. The wireless N communication device according to claim 13, wherein the first antenna and the second antenna are configured to perform transmission and reception of radio waves with bandwidths of 80 MHz, respectively, and the wireless LAN communication device is configured to perform the communication in a bandwidth of 160 MHz by the channel bonding.

* * * * *